US007934300B2

(12) United States Patent
Dallan

(10) Patent No.: US 7,934,300 B2
(45) Date of Patent: May 3, 2011

(54) METHOD FOR PRODUCING EXPANDED METAL PROFILES

(75) Inventor: Sergio Dallan, Castelfranco Veneto (IT)

(73) Assignee: Dallan S.p.A., Castelfranco Veneto (IT)

( * ) Notice: Subject to any disclaimer, the term of this patent is extended or adjusted under 35 U.S.C. 154(b) by 1171 days.

(21) Appl. No.: 11/629,786

(22) PCT Filed: Jun. 14, 2005

(86) PCT No.: PCT/EP2005/006340

§ 371 (c)(1),
(2), (4) Date: Dec. 15, 2006

(87) PCT Pub. No.: WO2005/123298

PCT Pub. Date: Dec. 29, 2005

(65) Prior Publication Data

US 2007/0137013 A1 Jun. 21, 2007

(30) Foreign Application Priority Data

Jun. 17, 2004 (IT) ..... VE2004A0027

(51) Int. Cl.
*B21D 31/04* (2006.01)

(52) U.S. Cl. ..... 29/6.1; 29/6.2; 29/896.6; 72/181; 72/186; 72/187; 72/302; 72/334; 72/339

(58) Field of Classification Search ..... 29/2, 6.1, 29/6.2, 896.6; 72/334, 339, 186, 187, 302, 72/181

See application file for complete search history.

(56) References Cited

U.S. PATENT DOCUMENTS

| | | | | |
|---|---|---|---|---|
| 1,796,978 A | | 3/1931 | Bates | |
| 3,298,081 A | * | 1/1967 | Terrell et al. | 29/6.2 |
| 3,763,616 A | | 10/1973 | Pastorelli | |

FOREIGN PATENT DOCUMENTS

| | | |
|---|---|---|
| GB | 1 308 560 | 2/1973 |
| WO | WO 01/42583 | 6/2001 |

* cited by examiner

*Primary Examiner* — Rick K Chang
(74) *Attorney, Agent, or Firm* — Themis Law

(57) ABSTRACT

A method for producing expanded metal profiles, consisting of subjecting a metal strip of width less than the development of the profile to be produced to the following operations: —forming longitudinal slits in at least that longitudinal band which is to form the central web of the profile, —bending the edges of the slits, —profiling said strip, —transversely stretching that band containing the slits, —pressing areas of said central web in correspondence with said stretched band to displace them external to the plane of said web, characterised by subjecting the bent edges to drawing to obtain radiused edging having the tangent to the free edge forming an angle not less than 90° to the surface of the strip.

7 Claims, 4 Drawing Sheets

FIG. 2
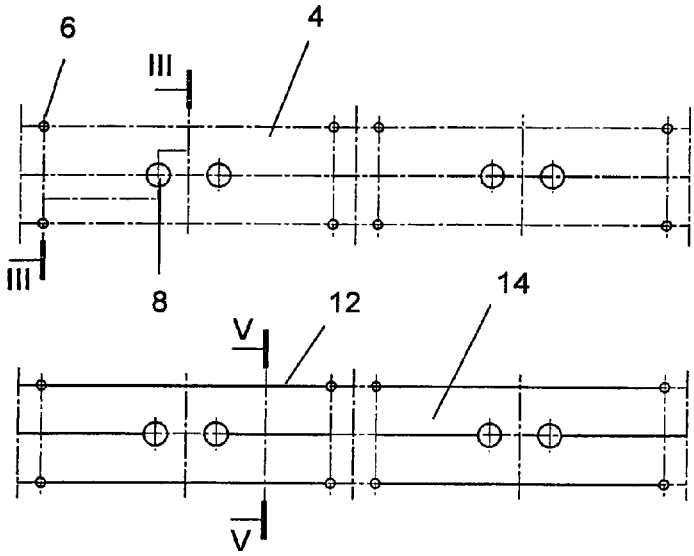
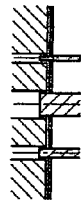
FIG. 3
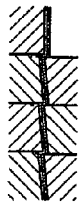
FIG. 5
FIG. 4

FIG. 6
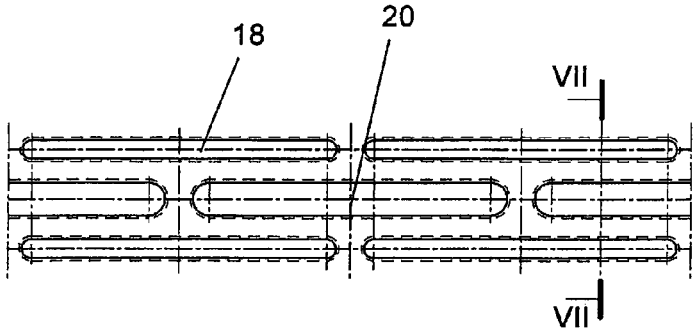
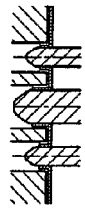
FIG. 7
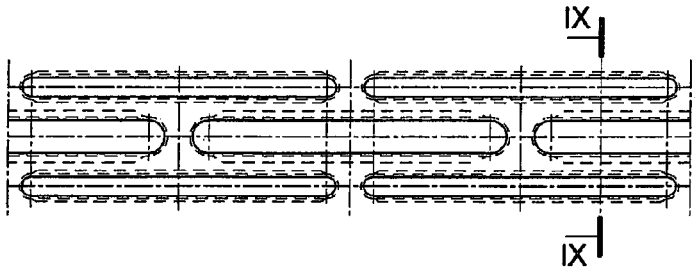
FIG. 8
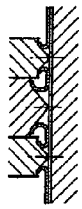
FIG. 9

FIG. 10
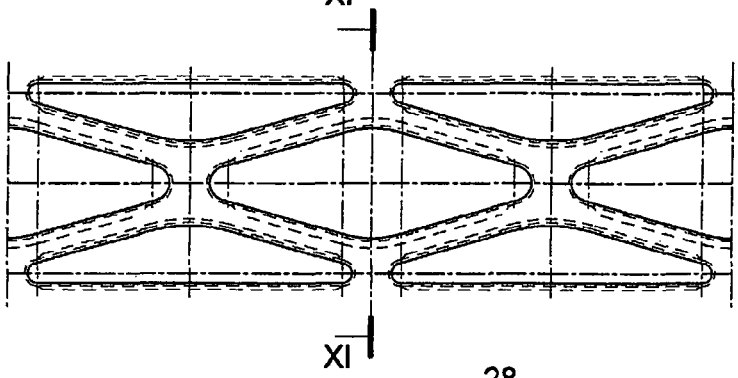
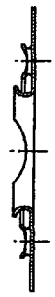
FIG. 11
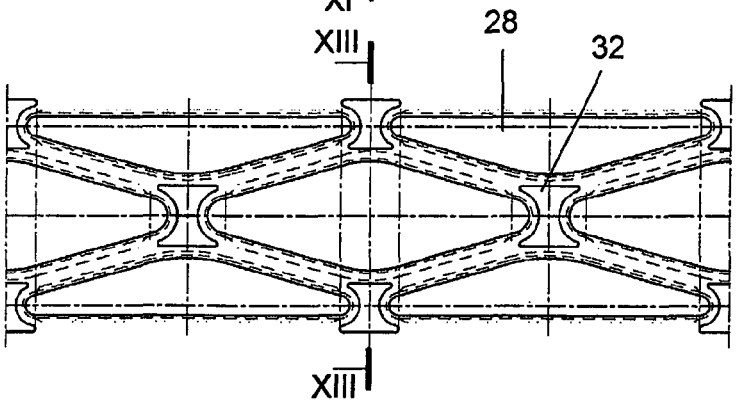
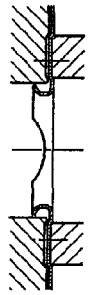
FIG. 13
FIG. 12

METHOD FOR PRODUCING EXPANDED METAL PROFILES

The present invention relates to a method for producing expanded metal profiles, and a profile produced by the method.

Metal structures, in particular C-shaped profiles, are known for supporting plasterboard or for forming shelves.

Said profiles comprise along their central web a plurality of longitudinally aligned holes of various shapes obtained by a process of transversely stretching the sheet metal strip in which a plurality of slits have previously been formed.

These known profiles present however certain drawbacks, and in particular:

- danger to the user handling the profile because of the cutting edges of the holes,
- said cutting edges can damage connection cables passing through these holes,
- cracking can occur at the ends of the holes, to weaken the profile and compromise its strength.

All these drawbacks are eliminated according to the invention by a method for producing expanded metal profiles as described hereinbelow.

Figure 1:
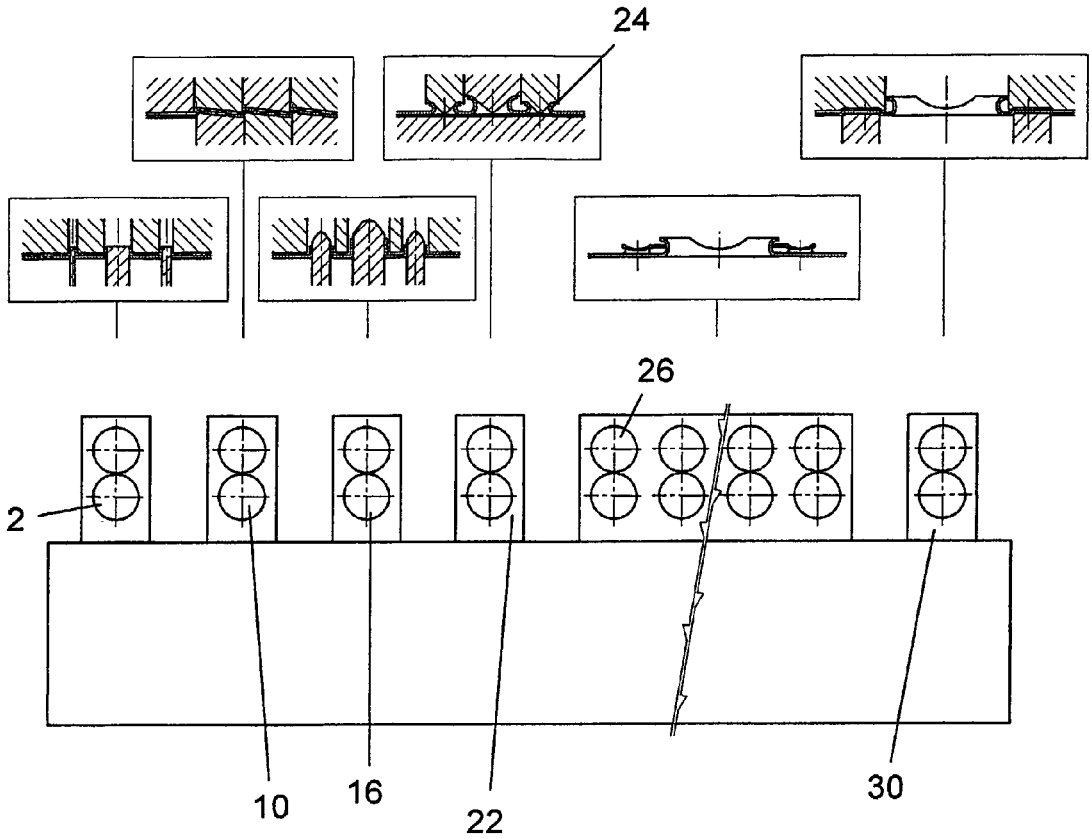

A preferred embodiment of the present invention is described hereinafter with reference to the accompanying drawings, in which:

FIG. 1 is a side view of an apparatus for implementing the method of the invention, FIG. 2 shows the sheet metal strip on termination of the hole forming stage, FIG. 3 is a cross-section on the line III-III of FIG. 2, FIG. 4 shows a sheet metal strip on termination of the incision stage, FIG. 5 is a section therethrough on the line V-V of FIG. 4, FIG. 6 is a plan view of the sheet metal strip on termination of the bending stage, FIG. 7 is a section therethrough on the line VII-VII of FIG. 6, FIG. 8 is a plan view of the sheet metal strip on termination of the drawing stage, FIG. 9 is a section therethrough on the line IX-IX of FIG. 8, FIG. 10 is a plan view of the sheet metal strip on termination of the stretching stage, FIG. 11 is a section therethrough on the line XI-XI of FIG. 10.

Figure 14:
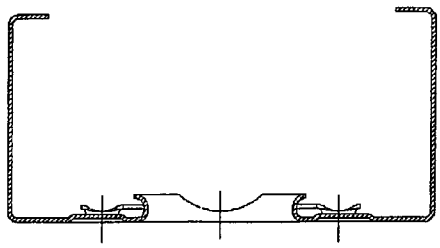

FIG. 12 is a plan view of the sheet metal strip on termination of the pressing stage, FIG. 13 is a section therethrough on the line XIII-XIII of FIG. 12, and FIG. 14 is a cross-section through a profile.

As can be seen from the figures, with the method of the invention the sheet metal strip, of width less than the development of the profile to be obtained, is unwound from a reel, and after being subjected to possible straightening operations, passes through:

- a pair of rollers 2 which form holes 6 and 8 respectively in the sheet metal strip 4 in correspondence with the regions to be slit,
- a pair of slitting rollers 10 which form in the strip a plurality of longitudinal slits 12, 14 of different length, aligned in parallel rows,
- pair of bending rollers 16 which, on the previously formed slits 12,14, form longitudinally slotted holes 18,20 with their edges bent towards the inside of the sheet metal strip,

- a pair of drawing rollers 22 having their punches shaped to curve the bent edges of the slotted holes to obtain a sort of radiused edging on each of said holes, with the tangent to its free edge forming an angle greater than 90° to the strip surface,
- a pair of stretching rollers 26 which exert transverse traction on the sheet metal strip to form apertures 28 at the holes 18,20,
- a pair of pressing rollers 30 which at regular intervals within the stretched central web form a series of bosses or reliefs which displace the corresponding portion of stretched band into a plane which is slightly spaced from the plane of the web itself,
- a plurality of profiling rollers which transform the stretched strip into a C profile or a shelf.

The continuous profile obtained in this manner is then cut transversely to size.

Depending on the final result to be obtained, different methods can be provided; for example the starting expanded metal strip can be firstly subjected to a stage of slitting with simultaneous stretching followed by a profiling stage; or it can be subjected firstly to a slitting stage, then to profiling and finally to stretching; or to a single slitting, stretching and profiling stage.

Pressing is carried out on termination of the profiling stage, although it can be done during passage through the profiling rollers or after stretching but before profiling. Instead of using pairs of rollers, the various operations can be carried out with presses or with presses and rollers.

From the aforegoing it is apparent that the method of the invention presents numerous advantages, and in particular:

- it eliminates any danger for the user as it forms holes with non-cutting edges,
- cables can be easily inserted as they encounter no friction with the hole edges,
- it eliminates any possible cracking because of the presence of previously formed holes in correspondence with the slits.

What is claimed is:

1. A method of producing expanded metal profiles comprising:

- forming a plurality of holes disposed longitudinally and centrally along a metal profile;
- forming longitudinal slits in the metal profile, each of the slits connecting a pair of the holes;
- causing a bending of lips defined by edges of the slits and the pair of the holes, thereby forming slots disposed longitudinally and centrally;
- profiling said metal profile;
- transversely stretching the metal profile containing the slots, thereby forming a stretched profile;
- pressing areas of the stretched profile to form bosses or reliefs; and
- drawing the lips to obtain radiused shapes, such that a tangent to a free edge of the lips forms angle greater than 90 degrees with respect to a central surface of the metal profile.

2. The method of claim 1, wherein said slits are formed simultaneously with the bending.

3. The method of claim 1, further comprising:

- forming a plurality of holes disposed longitudinally and laterally of the holes disposed centrally;
- forming additional longitudinal slits each connecting a pair of the holes disposed laterally;

bending of additional lips defined by edges of the additional longitudinal slits and the pair of the holes disposed laterally, thereby forming slots disposed longitudinally and laterally; and causing the additional lips to be formed into additional radiused shapes.

4. The method of claim 1, wherein said holes are formed simultaneously with the slits.

5. The method of claim 1, wherein the stretching takes place before the drawing.

6. The method of claim 1, wherein the profiling takes place before the pressing.

7. The method of claim 1, wherein the metal profile has a C-shaped cross section having a central web.

* * * * *